United States Patent [19]

Roloff

[11] Patent Number: 4,823,438

[45] Date of Patent: Apr. 25, 1989

[54] HINGE ASSEMBLY FOR SHOWER STALLS

[76] Inventor: Heinz-Rudolf Roloff, Hüttenallee 39, D-4150 Krefeld, Fed. Rep. of Germany

[21] Appl. No.: 151,900

[22] Filed: Feb. 3, 1988

[30] Foreign Application Priority Data

Feb. 5, 1987 [DE] Fed. Rep. of Germany ... 8701703[U]

[51] Int. Cl.[4] ..... E05F 1/08

[52] U.S. Cl. ..... 16/307; 16/304; 16/308

[58] Field of Search ..... 16/76, 277, 307, 308, 16/386, DIG. 36, 382; 4/557, 607, 610; 49/386; 267/155

[56] References Cited

U.S. PATENT DOCUMENTS

| | | | |
|---|---|---|---|
| 167,114 | 8/1875 | Parker | 16/307 |
| 441,547 | 11/1890 | Gilbert | 16/76 |
| 2,391,861 | 1/1944 | Bellows | 16/307 |
| 4,535,503 | 8/1985 | Narita et al. | 16/382 |

FOREIGN PATENT DOCUMENTS

| | | | |
|---|---|---|---|
| 453794 | 1/1949 | Canada | 16/307 |

*Primary Examiner*—Kuang Y. Lin
*Assistant Examiner*—William Scott Andes
*Attorney, Agent, or Firm*—Herbert Dubno

[57] ABSTRACT

A hinge assembly for shower stalls has a helical spring on the hinge pin, positioned in a gap between the coaxial hinge sleeves, the ends of this spring being attached respectively to the two pieces of the hinge so as to apply biasing spring tension to hold the door closed.

2 Claims, 1 Drawing Sheet

HINGE ASSEMBLY FOR SHOWER STALLS

FIELD OF THE INVENTION

The present invention refers to hinge assemblies, especially of a type useful for shower stalls.

BACKGROUND OF THE INVENTION

Shower stalls, in particular their walls and doors, usually are made of glass or some other transparent or translucent material. Their hinges are made of a corrosion resistant material, such as stainless steel or brass. The doors of shower stalls usually have no locking devices but merely have doorstop surfaces (i.e. flat flange-like surfaces which serve to stop further motion of the door when it is pushed shut) which must serve as a barrier to prevent shower water from escaping the stall. In order that the door of a shower stall shuts so as to be reasonably impenetrable to the shower water, it must be biased (pressed) against the doorstop surface when it is shut. This can be accomplished in some shower stall constructions by having the door pushed against the doorstop surface by gravity. It can also be accomplished with the help of springs. In this case, however, a simple construction which cannot be seen from the exterior for such a spring-biased hinge assembly has not hitherto been available.

OBJECTS OF THE INVENTION

It is one object of the invention to provide a hinge assembly suitable for use in shower stalls, by means of which the door of a shower stall can be biased by spring force against its doorstop surface.

It is a further object to have this biasing means visually unobtrusive.

SUMMARY OF THE INVENTION

The objects of the invention are achieved is a hinge which comprises two assembly pieces, for which the customary term "hinge leaves" will hereinafter be used, two hinge sleeves (sometimes called knuckles) attached to a first of these hinge leaves, both two hinge sleeves being coaxial with one another and at a distance from one another, another hinge sleeve attached to the second of the two hinge leaves and received between the two hinge sleeves of the first hinge leaf and coaxial to the two hinge sleeves.

A hinge pin (pintle) traverses all three coaxial hinge sleeves and serves to link rotatably the two hinge leaves of the hinge.

According to an important feature of the invention, one of the hinge sleeves of the first of the two hinge leaves is at a distance (i.e. is spaced) from the hinge sleeve of the second of the two hinge leaves thus defining an axially extending gap, and in this gap there is positioned a spiral spring surrounding the hinge pin, with a respective end of this spiral spring being attached respectively to each of the two hinge leaves, so as to bias the hinge and thus bias the door towards its closed position.

In the hinge assembly of the invention, the spring which guides or pushes the door against its doorstop surface is inconspicuously integrated into the fitting, as the result of having the spring in the form of a helical (or more precisely, a helix) surrounding the hinge pin in the sleeve-free gap. The diameter of the helical spring need not be greater than that of the hinge sleeves. Thus, the size of the hinge assembly does not have to be changed overall.

It will be understood that the helical spring should consist of a corrosion-resistant material, especially stainless steel.

It is advantageous to have the length of the helical spring correspond to the sleeve-free distance, so that the helical spring and the hinge sleeves, when viewed at some distance, appear as a integral structure.

The attachment of the spring ends to the two hinge leaves can be accomplished in a simple and advantageous manner if, attached to each of the two hinge leaves there is a socket sleeve for each end of the spring. The ends then need only to be inserted into these socket sleeves. Advantageously, the socket sleeves can be arranged next to and parallel to the hinge sleeves, requiring that the ends of the spring be bent at an angle so as to fit. The socket sleeves should be arranged on the inner surfaces of the hinge, so that they are invisible from the outside.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
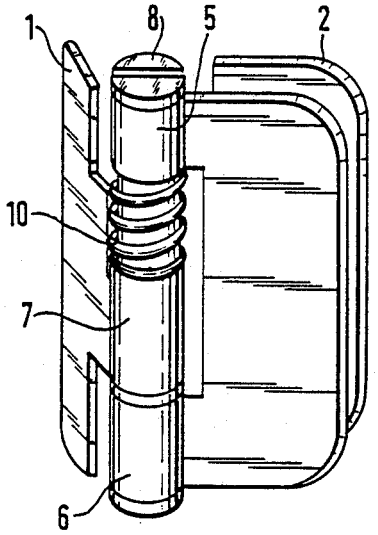
FIG. 1 is a perspective view of a hinge assembly for the door of a shower stall, intended to open outwards.
Figure 2:
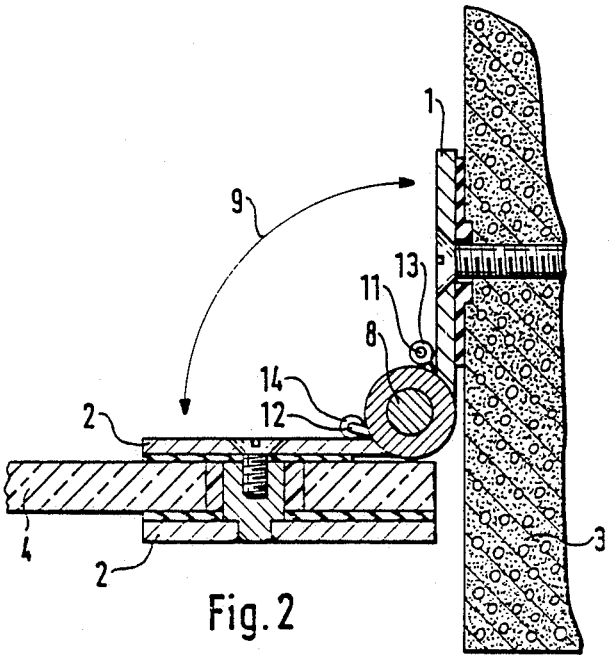
FIG. 2 is a cross section through a hinge assembly similar to that in FIG. 1, however for a shower stall door intended to open inwards.

The hinge assembly represented in the drawing consists of two hinge leaves 1 and 2. The hinge leaf 1, as shown in FIG. 2, is attached to the wall 3 of the shower stall, and the hinge leaf 2 is attached to a glass door 4 of the shower stall.

To hinge assembly 2 there are attached two hinge sleeves 5 and 6 which are positioned coaxially and at some distance from one another. To hinge leaf 1 there is attached a hinge sleeve 7, which penetrates between the two coaxial sleeves 5 and 6. Both hinge leaves 1 and 2 are linked by a hinge pin 8, which is inserted into the hinge sleeves 5, 6 and 7 which are aligned with one another. The hinge pin 8 forms a hinge axle or pintle, around which the glass door 4 is swingable in the direction of the double arrow 9 relative to the wall 3.

The other two hinge sleeves 5 and 6 have their opposing interior ends further apart than the length of the sleeve 7 between them, and in the sleeve-free gap between the sleeve 7 and the outer hinge sleeve 5 there is positioned a helical spring 10, surrounding the hinge pin 8. The outside diameter of the helical spring 10 corresponds approximately to the outside diameter of the hinge sleeves 5, 6 and 7. The helical spring 10 extends the entire length of the sleeve-free distance.

The ends 11 and 12 of the helical spring 10 are bent so as to be parallel to the hinge pin 8 and inserted into socket sleeves 13 and 14, which are attached to the hinge leaves 1 and 2. The socket sleeve 13 is immediately next to the hinge sleeve 5 and arranged parallel to it. The socket sleeve 14 is immediately next to the middle hinge sleeve 7 and arranged parallel to it. Both socket sleeves 13 and 14 are arranged on the inner side of the hinge.

It will be understood that the helical spring exerts its tension such that the glass door 4 is biased towards its closed position. All the parts of the hinge assembly are made of corrosion resistant material.

It is Claimed:

1. A hinge assembly for shower stalls, comprising:

a hinge pin having an axis;

first and a second hinge sleeves mounted at opposite ends of said pin and rotatable about said axis, said first and second hinge sleeves being axially spaced apart;

first and a second hinge leaves, said leaves having respective interior sides, said first hinge leaf being connected with said first and second hinge sleeves;

a third hinge sleeve rotatably mounted on said hinge pin between said first and second hinge sleeves and spaced from said first sleeve, said third and first hinge sleeves defining an axially extending gap therebetween, said third sleeve being adjacent to said second sleeve and connected with said second hinge leaf;

first and a second socket sleeves at the respective first and second leaves, said socket sleeves being parallel to said axis and fixed on the respective interior sides against said first and third hinge sleeves; and a helical spring having two ends, said helical spring being coiled around said hinge pin and positioned in said gap, each of said ends of said spring being received by a respective one of said socket sleeves, so that said hinge leaves are biased toward each other by spring tension.

2. The hinge assembly defined in claim 1 wherein said helical spring has a length corresponding to a length of said gap between said third and first hinge sleeves.

* * * * *